US005121595A

United States Patent [19]

Shore

[11] Patent Number: 5,121,595

[45] Date of Patent: Jun. 16, 1992

[54] BALLOON INFLATING MACHINE

[75] Inventor: William P. Shore, Ashfield, Australia

[73] Assignee: The Commonwealth Industrial Gases Limited, St. Leonards, Australia

[21] Appl. No.: 667,846

[22] Filed: Mar. 12, 1991

[30] Foreign Application Priority Data

Mar. 23, 1990 [AU] Australia ..... PJ9289

[51] Int. Cl.[5] ..... B65B 31/06; B65B 43/36

[52] U.S. Cl. ..... 53/79; 53/84; 53/88; 53/385.1; 141/173

[58] Field of Search ..... 53/79, 385.1, 88, 84, 53/403, 411, 469, 131.1, 459, 472, 137.2, 138.3, 138.4; 141/173

[56] References Cited

U.S. PATENT DOCUMENTS

| | | | |
|---|---|---|---|
| 2,886,928 | 5/1959 | Pearce et al. | 53/79 |
| 3,380,490 | 4/1968 | Ellenberg et al. | 141/173 X |
| 3,536,110 | 10/1970 | West | 141/173 X |
| 3,616,823 | 11/1971 | Dello Iacono | 141/173 X |
| 3,911,972 | 10/1975 | Hübers et al. | 53/88 X |
| 3,932,977 | 1/1976 | Ringler | 53/88 X |
| 4,114,350 | 9/1978 | Snyder | 53/79 |
| 5,016,428 | 5/1991 | Helling et al. | 53/403 |

*Primary Examiner*—Horace M. Culver

*Attorney, Agent, or Firm*—David A. Draegert; Robert I. Pearlman

[57] ABSTRACT

A gas operated balloon inflating machine for inflating balloons of the kind having a body and a filling neck terminated in a beaded edge. The apparatus includes a gas operated releasable clamping device to secure the beaded edge of the balloon between a support surface and a sealing surface thereby providing for inflation of the balloon from an aperture in the sealing surface. A gas operated control valve selectively supplies gas to the aperture from a reservior and a gas operated sealing device is used to seal the neck of the balloons after inflation. A logic controller selectively supplies pressurized gas from a high pressure source to the clamping device, control valve and sealing means to sequentially clamp, inflate, seal and release balloons. The exhaust gas from each of these devices is directed to the reservoir for inflation of the balloons. The size to which the balloons are inflated is preferably controlled by the size of the inflating reservoir and regulation of the pressure in the reservoir.

6 Claims, 6 Drawing Sheets

BALLOON INFLATING MACHINE

The present invention relates to the inflation of balloons of the kind having a body and a filling neck terminating in a beaded edge.

Mass releases of balloons filled with a lighter than air gas mixture are commonly used to promote major public events. Large numbers of balloons are also used for displays and decoration in indoor applications. These applications require the filling of many thousands of balloons over a relatively short period of time because the balloons remain properly inflated for only a limited time. Hitherto the balloons have been filled manually by teams of people each using a manually operated filling device. Typically the manual filling devices include a nozzle over which the neck of the balloon is stretched before being inflated with gas from a pressurized source. The gas flow is controlled by a manually operated valve and the degree of inflation is determined visually by the operator. After inflation the balloon is removed from the nozzle and the neck of the balloon is sealed with a tying device applied by the operator. This method of inflating balloons suffers from several inherent disadvantages including:

(a) It is labour intensive and time consuming. A skilled operator has difficulty filling more than about 175 balloons per hour. Consequently many operators are required to inflate the thousands of balloons required for mass releases with the relatively short inflated balloon lifetime.

(b) The manual stretching of the balloons over the prior art filling nozzle can lead to damage of the filling neck and failure of the balloon.

(c) The visual determination of degree of inflation results in non uniformity of balloon size and, in cases of over inflation, failure of the balloon.

(d) Removal of the balloons from the prior art filling nozzle and manual tying can also result in gas loss and/or damage to the balloon.

One proposed solution to this problem has been described in our copending patent application No. PJ5785 the description of which is incorporated herein by reference. The machine disclosed in PJ5785 is electrically and pneumatically operated and therefore requires external power sources for operation. A need also exists for an automatic or semi-automatic balloon inflating machine that is fully self powered.

It is an object of this invention to provide a balloon inflating machine which will overcome, or at least ameliorate, one or more of the above disadvantages.

According to the invention there is provided a gas operated balloon inflating machine for inflating balloons of the kind having a body and a filling neck terminated in a beaded edge, said apparatus comprising a gas operated releasable clamping device for securing the beaded edge of a balloon between a support surface and a sealing surface to establish fluid flow communication to said balloon from an aperture in said sealing surface, a gas operated control valve to selectively supply a flow of pressurized gas to said aperture from a reservoir, gas operated sealing means to seal the neck of said balloon after inflation, a high pressure gas source, logic means to selectively supply an actuating supply of pressurized gas from said high pressure source to said clamping device, control valve, and sealing means to sequentially clamp. inflate, seal and release balloons, the exhaust gas from said clamping device, control valve and sealing means being diverted to said reservoir for inflation of the balloons.

Preferably means are provided to control the size to which the balloons are inflated. In the preferred embodiment this is achieved by selecting the size of the inflating reservoir and regulating the pressure of the reservoir such that exhaustion of the gas in the reservoir to the or each balloon results in the desired degree of inflation. Pressure regulation of the reservoir is preferably achieved by "topping up" the reservoir after the exhaust gas from the preceding operations has been vented into the reservoir and prior to inflation of the balloons. This is preferably achieved by a control valve which controls the flow of gas to a regulator from the high pressure source.

Preferably also the logic means comprises a plurality of gas actuated valves interconnected to form a 'cascade' control system.

A preferred embodiment of the invention will now be described, by way of example only, with reference to the accompanying drawings in which.

Figure 1:
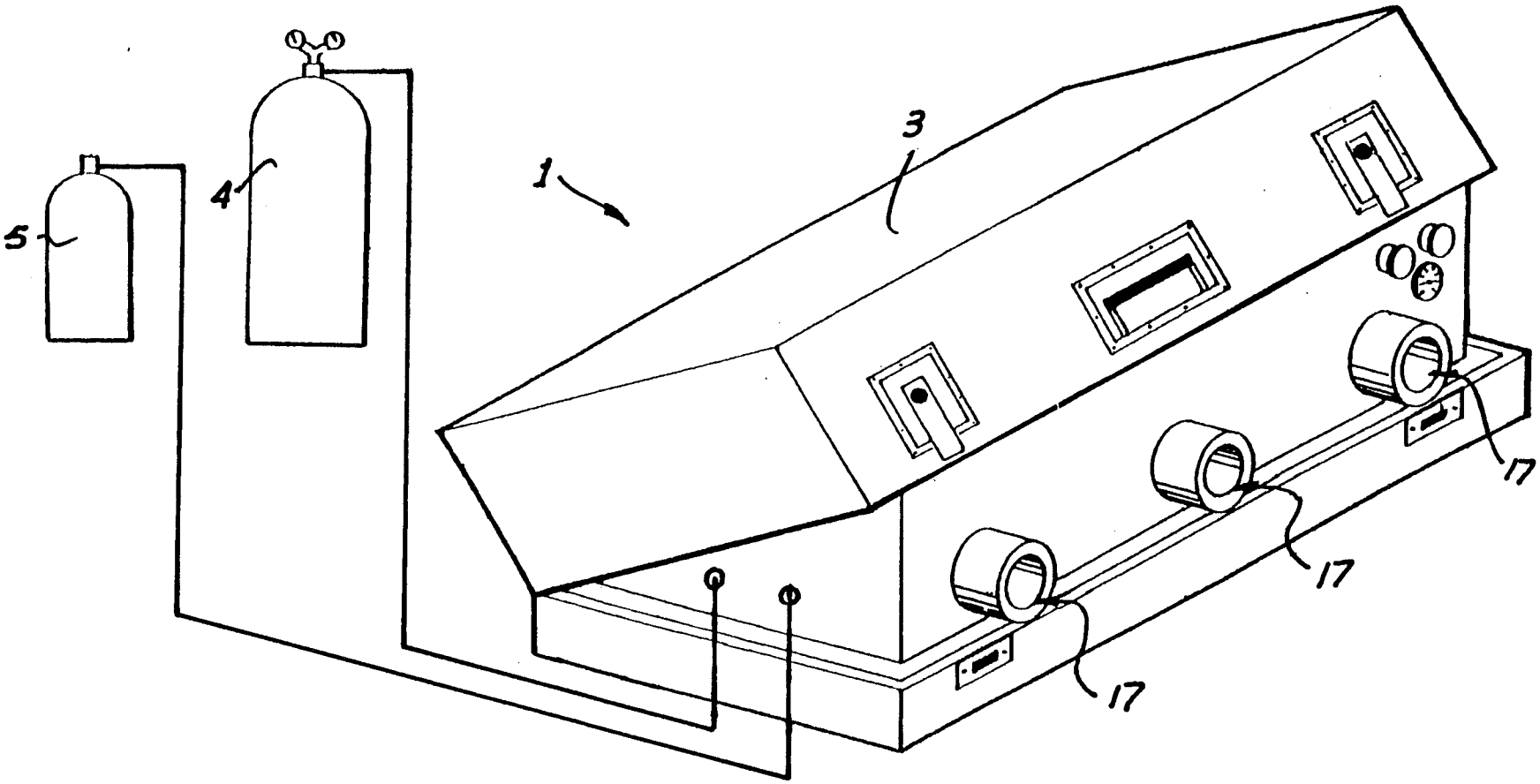
FIG. 1 is a schematic perspective view of a balloon inflating machine according to the invention.
Figure 3:
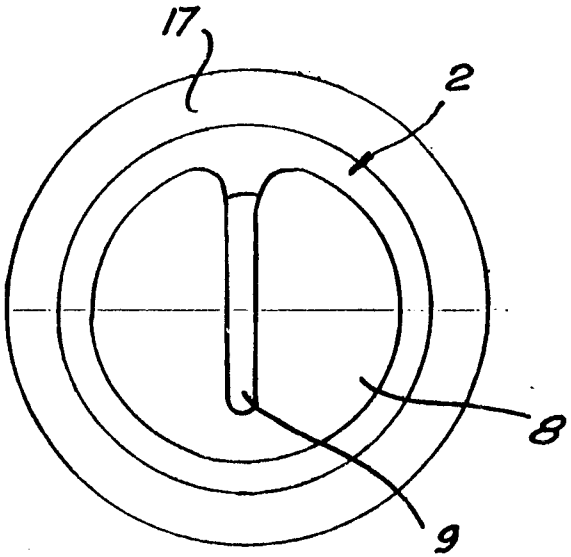
FIG. 3 is a schematic end view of the filling station shown in FIG. 2.

Referring to FIG. 1 there is shown a schematic perspective view of a semi-automatic balloon inflating machine indicated generally at 1, comprising three rotating rings generally indicated at 17 housed in a cabinet 3. Connected to the cabinet 3 is a high pressure gas source in the form of a helium cylinder 4 and an intermediate pressure reservoir in the form of a storage cylinder 5.

Referring now in particular to FIGS. 2 to 6 the filling stations 2 each include a balloon clamping device 6 and a balloon filling nozzle 7. Each clamping device 6 comprises a balloon support plate 8 having a slot 9 adapted to receive and retain the neck 10 of a balloon 11. The balloon is orientated such that its beaded edge 13 seats against a support surface 12 of the support plate 8. The filling nozzle 7 is in the form of an aperture provided in a clamping piston 14 which connects to storage cylinder 5 by means not shown. The clamping piston 14 is biased toward support surface 12 by means of a helical compression spring 15 which urges a sealing surface 16 of piston 14 against the beaded edge 13 of the balloon to provide a substantially gas tight connection. Thus gas expelled from the centrally located filling nozzle 7 is directed into balloons 11 to inflate the balloon. The clamping piston 14 is powered by a gas operated cylinder (not shown) hereinafter referred to as C1.

Figure 5:
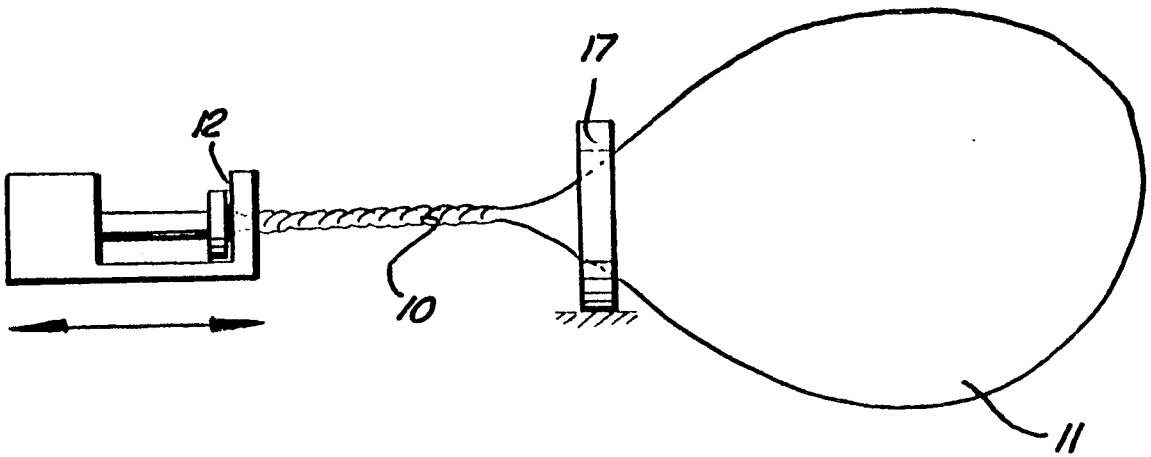
FIG. 5 is a schematic side view of the filling station shown in FIG. 4 illustrated in the retracted configuration to facilitate sealing of the balloon by twisting and sealing of the balloon neck.
Figure 4:
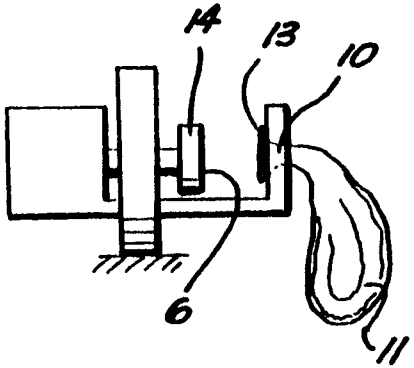
FIG. 4 is a schematic side view of the filling station shown in FIG. 2 illustrated in the advanced loading position.
Figure 6:
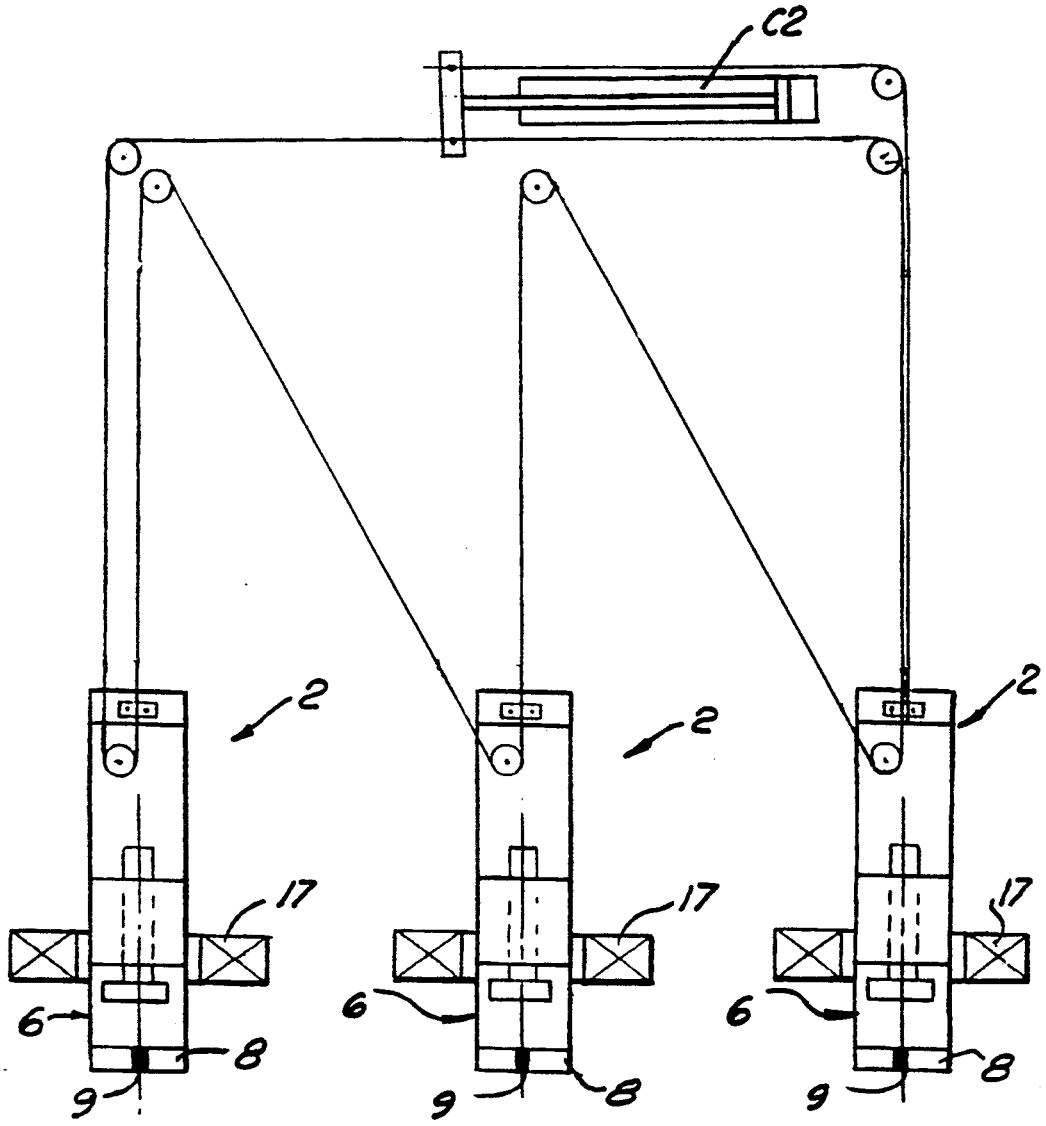
FIG. 6 is a schematic plan view of the filling head advancement and retraction system forming part of the balloon inflating machine used for twisting and sealing of the balloon neck.

Disposed co-axially to each clamping device 6 is a rotatable ring 17. The ring 17 is fixed in its location relative to cabinet 3 whilst the clamping device 6 is reciprocally movable through the ring along its axis between an advanced position for loading the balloons and a retracted position for stretching the necks of the balloons as shown in FIGS. 4 and 5 respectively. The reciprocal movement of clamping devices 6 is effected by means of a pulley system as shown in FIG. 6 driven by a gas operated cylinder hereinafter referred to as C2.

The sequence of basic operations is as follows. A balloon 11 is placed into slot 9 as illustrated in FIG. 4. The clamping piston 14 is bought into sealing contact with the beaded edge 13 of balloon 11 by means of the compression spring 15 in combination with the gas operated cylinder C1. Helium gas is then provided to aperture 7 from storage cylinder 5 by means of a valve V5 and the balloon 11 is inflated. After inflation the balloons are sealed by first stretching and twisting the necks 10 of balloons 11 before sealing with adhesive tape. In order to achieve this, cylinder C2 is actuated to retract the filling heads 2 thereby pulling the necks 10 of the inflated balloons through rings 17 as shown in FIG. 5. During this operation the ring 17 is rotated by means of a gas operated motor 18 causing the necks 10 of the balloons 11 to be simultaneously stretched and twisted in the manner shown. At this stage conventional bag sealers (not shown) that dispense adhesive tape are employed to seal and tie the inflated balloons. The bag sealers are activated by a further gas operated cylinder C3. The clamping piston 14 is then released and the clamping device 6 returned to the advanced position from which the inflated balloons are released by retraction of cylinder C2.

Figure 7:
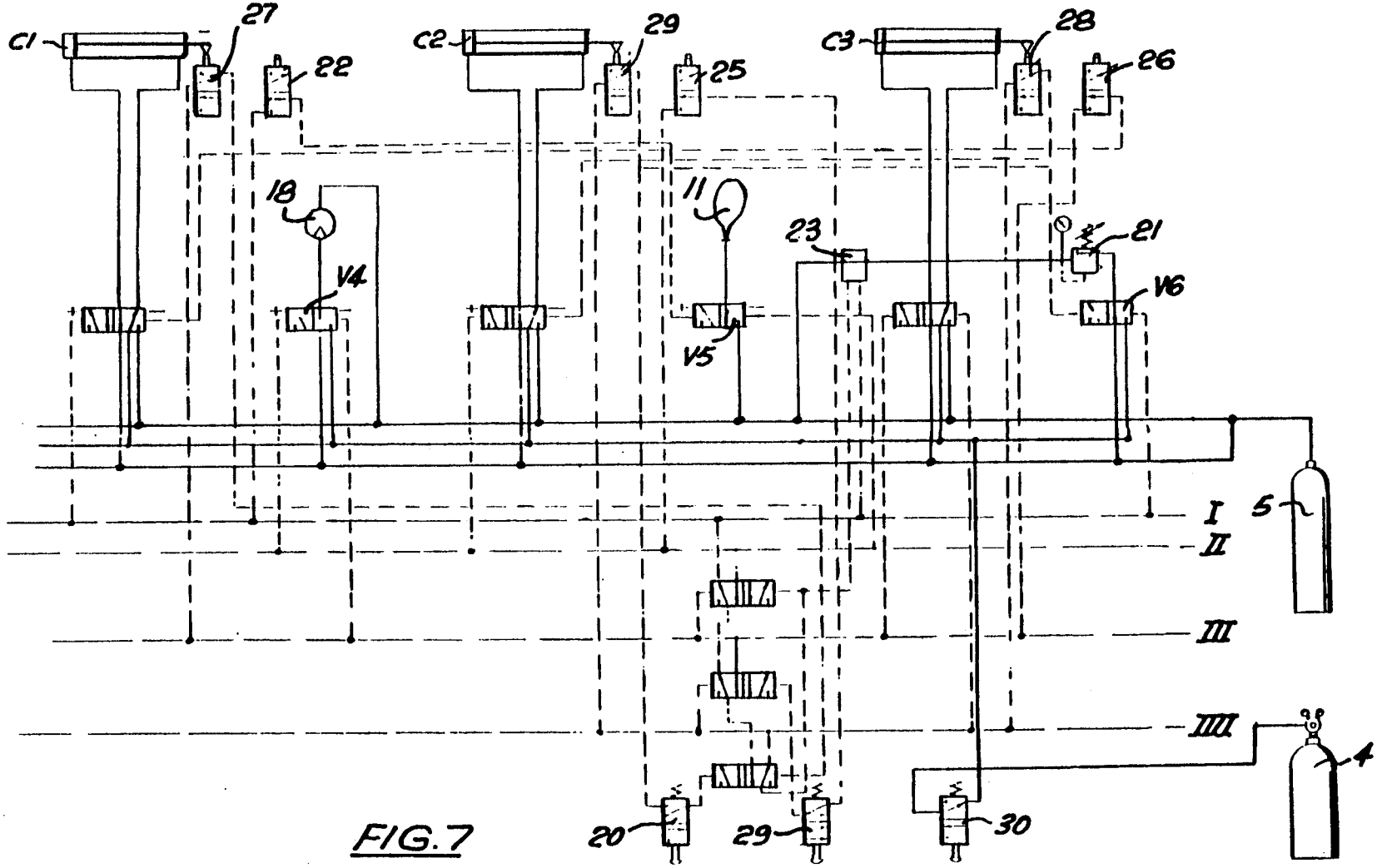
FIG. 7 is a schematic circuit diagram of the apparatus shown in FIG. 1.
Figure 8:
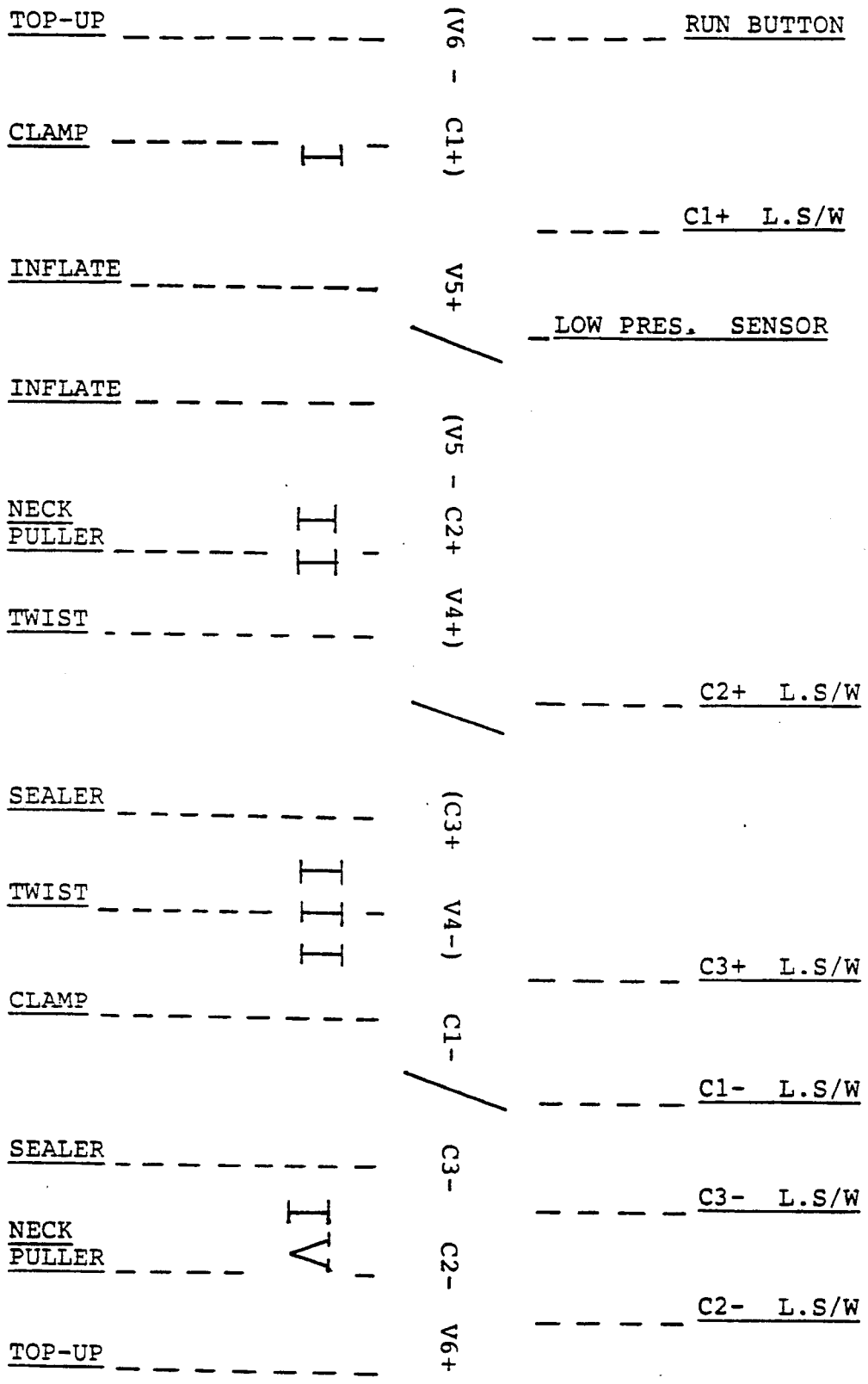
FIG. 8 is the sequence formula for the 'cascade' logic system for controlling the sequencing of the balloon inflating machine.

Referring now to FIG. 7 there is shown a schematic circuit diagram for operation of the balloon inflating machine 1. In order to achieve the above discussed sequence of operations, without the need for an external power supply, the gas used for inflation of the balloons 11 is also used to power the devices used to clamp and seal the balloons. This is achieved by using a plurality of five port two way valves configured to provide a logic controller in the form of cascade system.

The cascade logic sequence comprises four stages denoted on the circuit diagram in FIG. 7 by lines I to IV. Each stage must be completed before the next stage commences. The procedure will now be described in more detail with reference to the control hardware. All the cylinders, valves and gas motor are actuated by the high pressure helium gas from cylinder 4.

Figure 2:
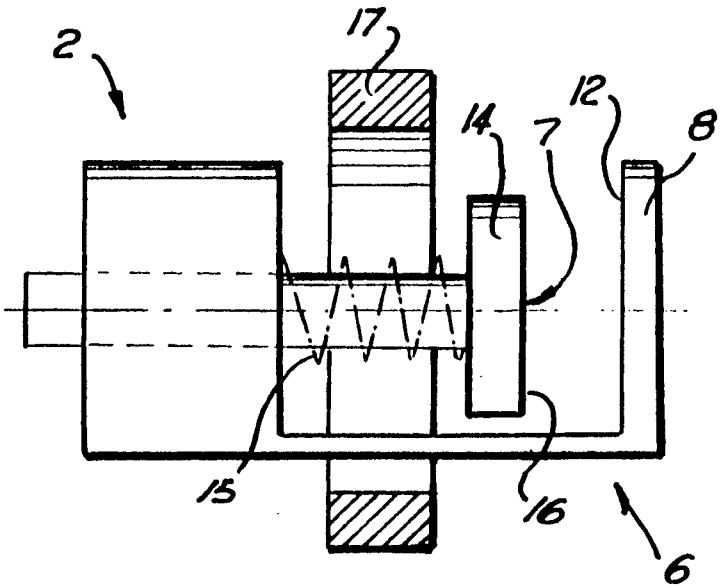
FIG. 2 is a schematic side view of a balloon filling station forming part of the apparatus of FIG. 1.

At commencement of the operation the clamping devices 6 are in the advanced position for loading as shown in FIGS. 2 and 4. A balloon 11 is manually positioned in each support plate 8 and a start valve 20 operated. This activates all components linked to line I as illustrated. At the conclusion of the preceding cycle a top-up valve V6 was open to direct gas from the helium cylinder 4 into the storage cylinder 5 via a regulator 21 until a predetermined pressure was reached. At the commencement of the new cycle valve V6 is shut. Simultaneously, the clamping cylinder C1 is actuated driving the clamping pistons 14 into abutment with the beaded edge of balloons 11. Completion of the clamping operation is registered via a position sensor 22 which in turn activates the balloon inflation valve V5.

The opening of valve V5 allows gas from storage cylinder 5 to inflate the balloons 11. A low pressure sensor 23 is provided to detect when the contents of storage cylinder 5 has been depleted thereby simultaneously signalling that inflation of the balloons is complete and the logic valves switch to stage II of the sequence.

At this stage three actions occur simultaneously. The balloon inflation valve V5 is closed whilst the cylinder C2 is activated to slidably retract the clamping devices 6 to stretch the neck portions 10 of the balloons. At the same time a valve V4 is activated which starts up the air motor 18 causing ring 17 to rotate thereby simultaneously twisting the neck of the balloons whilst they are being stretched. When the cylinder C2 has fully retracted the clamping devices 6, a position sensor 25 is actuated signalling the end of stage II of the sequence and causing the logic control valves to switch to stage III of the operation. During stage III the valve 4 is closed to stop air motor 18. At the same time the sealer cylinder C3 is actuated to bring the sealing devices into engagement with the stretched and twisted necks 10 of the balloons 11. The sealing is achieved by substantially conventional bag sealers which apply a piece of adhesive tape to the twisted neck portion in the known manner. When the forward stroke of cylinder C3 is completed, a further position sensor 26 is actuated which signal the clamping cylinder C1 to release the clamping piston 14 from each balloon 11. When the cylinder C1 is fully retracted a position sensor 27 is actuated and the logic valve switches to stage IV.

At stage IV the sealer cylinder C3 is reversed until a position sensor 28 is activated and the balloons are released. This causes cylinder C2 to return the clamping devices 6 to the start position. During the sequence the exhaust gas from the cylinders, valves and motor is diverted back to storage cylinder 5. When the cylinder C2 is fully reversed the position sensor 29 is activated which signals opening of the top-up valve V6 to top up storage cylinder 5 to a predetermined pressure in preparation for a repeat of the filling cycle.

A park valve 29 is also provided in the circuit enabling the sequence to be placed on hold at any given time. An emergency stop valve 30 provided in the main line from helium cylinder 4 facilitates complete shut down of the machine if required.

The above described embodiment of the invention provides a compact and portable balloon inflation machine of the approximate size of a suitcase.

If desired a ribbon dispenser can be incorporated with each inflating station for adhesion to the balloon during the sealing process. Similarly, whilst this embodiment of the machine utilised a cylinder of high pressure compressed helium, in other embodiments it is connected directly to a compressor.

Apart from the advantages of being self-powered, the invention has several additional advantages over and above the prior art. The use of an intermediate reservoir in the form of a storage cylinder 5 facilitates accurate inflation of the balloons through regulation of the pressure and volume of gas in the cylinder. Previous methods have utilized limit switches to detect the inflated size of the balloons. This was unsatisfactory as the balloons would not necessarily inflate evenly and furthermore the switches would need to be adjusted according to the various shapes and sizes of balloons to be inflated. The present method of inflation not only results in balloons of a predetermined uniform size, but substantially reduces the losses through bursting and over filling of the balloons.

Although the invention has been described with reference to specific examples, it will be appreciated by those skilled in the art that the invention may be embodied in many other forms.

I claim:

1. A gas operated balloon inflating machine for inflating balloons of the kind having a body and a filling neck terminated in a beaded edge, said apparatus comprising a gas operated releasable clamping device for securing the beaded edge of a balloon between a support surface and a sealing surface to establish fluid flow communication to said balloon from an aperture in said sealing surface, a gas operated control valve to selectively supply a flow of pressurized gas to said aperture from a reservoir, gas operated sealing means to seal the neck of said balloon after inflation, a high pressure gas source, logic means to selectively supply an actuating supply of pressurized gas from said high pressure source to said clamping device, control valve, and sealing means to sequentially clamp, inflate, seal and release balloons, the exhaust gas from said clamping device, control valve and sealing means being diverted to said reservoir for inflation of the balloons.

2. A gas operated balloon inflating machine according to claim 1 including means to control the size to which the balloons are inflated.

3. A gas operated balloon inflating machine according to claim 2 wherein control of the size to which the balloons are inflated is achieved by the size of the inflating reservoir and pressure regulation of the reservoir such that exhaustion of the gas in the reservoir to the balloon results in the desired degree of inflation.

4. A gas operated balloon inflating machine according to claim 1 wherein pressure regulation of the reservoir is achieved by adding gas to the reservoir after the exhaust gas from the preceding operations has been vented into the reservoir and prior to inflation of the balloons.

5. A gas operated balloon inflating machine according to claim 4 wherein gas is added to the reservoir by means of a control valve which controls the flow of gas to a regulator from the high pressure source.

6. A gas operated balloon inflating machine according to claim 1 wherein the logic means comprises a plurality of gas actuated valves interconnected to operate sequentially.

* * * * *